US007036483B2

(12) United States Patent
El Tahry et al.

(10) Patent No.: US 7,036,483 B2
(45) Date of Patent: May 2, 2006

(54) DIESEL ENGINE WITH DUAL-LOBED INTAKE CAM FOR COMPRESSION RATIO CONTROL

(75) Inventors: Sherif H. El Tahry, Troy, MI (US); Roger B. Krieger, Birmingham, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/739,462

(22) Filed: Dec. 18, 2003

(65) Prior Publication Data

US 2005/0132982 A1 Jun. 23, 2005

(51) Int. Cl.
*F02B 75/02* (2006.01)

(52) U.S. Cl. ..... 123/316

(58) Field of Classification Search ..... 123/316, 123/90.31, 90.6, 90.17, 90.18, 90.15, 90.16
See application file for complete search history.

(56) References Cited

U.S. PATENT DOCUMENTS 4,399,784 A * 8/1983 Foley ..... 123/198 F
4,587,934 A * 5/1986 Moores ..... 123/90.18
4,768,475 A * 9/1988 Ikemura ..... 123/90.16
5,080,055 A * 1/1992 Komatsu et al. ..... 123/90.17
5,129,407 A * 7/1992 Phillips ..... 123/90.18
5,253,546 A * 10/1993 Elrod et al. ..... 74/567
5,253,622 A * 10/1993 Bornstein et al. ..... 123/90.17
5,287,840 A * 2/1994 Catanu et al. ..... 123/508
6,170,449 B1 * 1/2001 Saiki et al. ..... 123/90.22
6,202,610 B1 * 3/2001 Yoshiki et al. ..... 123/90.15
6,352,060 B1 * 3/2002 Bentley ..... 123/90.15
6,705,259 B1 * 3/2004 Sellnau et al. ..... 123/90.16
6,854,432 B1 * 2/2005 Hirano ..... 123/90.16

* cited by examiner

*Primary Examiner*—Henry C. Yuen
*Assistant Examiner*—Jason Benton
(74) *Attorney, Agent, or Firm*—Kathryn A. Marra

(57) ABSTRACT

Dual-lobed cams mounted on the intake camshaft of a diesel engine selectively retard timing of the intake valve closure. The purpose of retarding timing of the intake valves is to retard valve closing sufficiently to shorten the effective compression strokes of the pistons and thus reduce the effective compression ratio. This occurs when the intake valves remain open past piston bottom dead center for a desired period into the normal compression stroke phase of engine operation. This reduces compression pressures so that combustion temperatures are reduced and exhaust emissions, primarily NOx, may be thus limited under conditions of warmed-up engine operation. Dual-lobed cams may also be employed to retard timing of the intake valve opening to throttle admitted air during cold running conditions to effect higher in-cylinder charge temperatures to reduce hydrocarbon and white smoke emissions due to poor ignition and incomplete combustion.

20 Claims, 3 Drawing Sheets

DIESEL ENGINE WITH DUAL-LOBED INTAKE CAM FOR COMPRESSION RATIO CONTROL

TECHNICAL FIELD

This invention relates to diesel engines and, more particularly, to control of cylinder compression ratio using a dual-lobed intake cam.

BACKGROUND OF THE INVENTION

It is known in the art to provide means for varying the compression ratio of a diesel engine in order to provide a relatively high compression ratio for cold starting and warm-up, where compression ignition is more difficult, and to provide reduced compression ratios for operating in other modes, particularly at high loads and speeds, to reduce peak combustion pressures and temperatures. Recently the emphasis for such arrangements is primarily to minimize emissions of nitrogen oxides (NOx) by operating at lower compression ratios where this is possible. Many devices have been proposed for compression ratio variation, including variable valve timing mechanisms and engine components such as pistons and cylinder heads with movable combustion chamber walls. In general these devices are relatively complex and add significant cost to the manufacture of an engine.

In spark ignition engines, dual-lobed cams with lobe selection mechanisms are known devices for varying valve timing, duration and lift thus changing valve timing. These devices normally provide for both advancing valve opening and retarding valve closing in order to obtain desirable performance characteristics. It is believed that dual-lobed cams with lobe selection mechanisms have not been utilized on diesel engines because the piston to cylinder head clearance is so small that altering intake and exhaust valve timing may result in contact of the pistons with the valves. A simple and relatively low cost apparatus and method for controlling compression ratio in a diesel engine is desired.

SUMMARY OF THE INVENTION

The present invention provides a desired engine combination by the addition of dual-lobed cams with lobe selection mechanism capable of retarding the closure timing of only the intake valves of a diesel engine in order to reduce its compression ratio. A typical diesel engine has cylinders and pistons defining expansible combustion chambers into which air is admitted and compressed during compression strokes of the pistons. Compression increases the air temperature so that injected fuel is self-ignited and burns, creating power to drive a crankshaft. Intake and exhaust valves, actuated by separate crankshaft driven intake and exhaust camshafts, control timed admission of air to and discharge of exhaust products from the combustion chambers.

In accordance with the invention, dual-lobed cams with lobe selection mechanisms are mounted in the valve train and are operable to selectively retard timing of only the intake valves relative to the crankshaft. The purpose of retarding timing of the intake valves is to retard valve closing sufficiently to shorten the effective compression strokes of the pistons and thus reduce the effective compression ratio. This occurs when the intake valves remain open past piston bottom dead center for a desired period into the normal compression stroke phase of engine operation.

This reduces compression pressures in the combustion chambers so that combustion temperatures are reduced and exhaust emissions, primarily NOx, may be thus limited under conditions of warmed-up engine operation.

Additional reductions in combustion temperatures can be achieved, in conjunction with use of dual-lobed intake cams in turbocharged or supercharged diesel engines, by increasing the intake boost pressure to maintain constant trapped air mass in the cylinder, even when intake valve closing retard is utilized. This approach allows maintaining lower combustion temperatures, thus inhibiting NOx and soot formation by preventing increases in fuel-air ratio as compression ratio is decreased.

For cold running conditions to avoid excessive hydrocarbon and white smoke emissions from poor ignition and incomplete combustion, a dual-lobed cam can also be used to increase charge temperature by delaying intake valve opening. This increases the pumping losses which are converted into thermal energy thus raising the in-cylinder charge temperature. This increased charge temperature improves ignitability of the charge and completeness of combustion.

These and other features and advantages of the invention will be more fully understood from the following description of certain specific embodiments of the invention taken together with the accompanying drawings.

DESCRIPTION OF THE PREFERRED EMBODIMENT

A diesel engine has a variable compression ratio in accordance with the invention. A diesel engine conventionally includes a plurality of cylinders having therein reciprocable pistons connected with a crankshaft. The ends of the cylinder are closed by a cylinder head so that the cylinders and pistons define expansible combustion chambers.

The cylinder head is provided with intake valves which control the timing and flow of intake air into the cylinders during intake strokes of the pistons. Exhaust valves in the cylinder head control timing and flow of exhaust products from the combustion chambers during exhaust strokes of the pistons. In the engine there may be multiple intake valves and multiple exhaust valves for each cylinder, however, any suitable number of valves provided for operation of the engine may be utilized in accordance with the invention.

The intake and the exhaust valves are actuated by separate intake and exhaust camshafts through rocker arms. The intake and exhaust camshafts exclusively operate their respective intake and exhaust valves, however, both are driven by the crankshaft through a timing chain.

Figure 1:
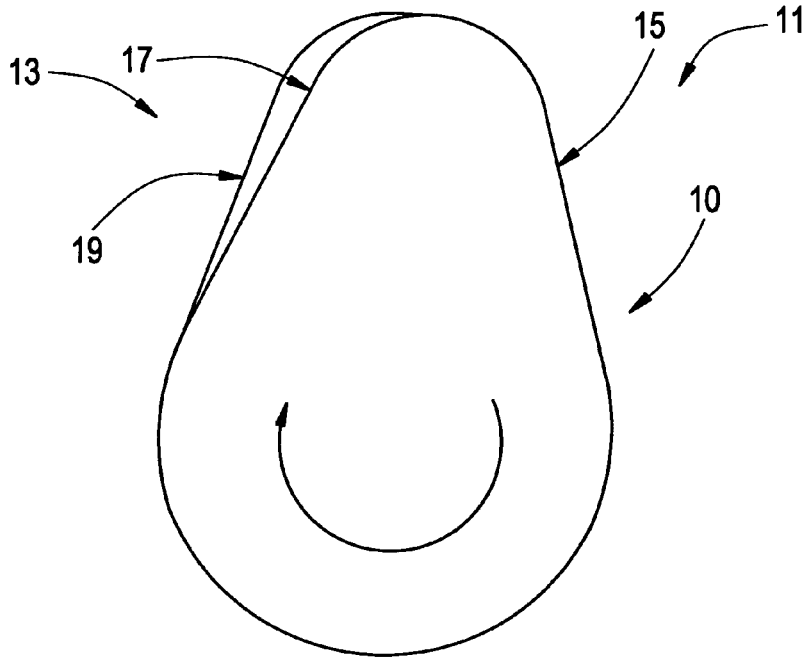
FIG. 1 is a profile view of a first dual-lobed intake cam for a diesel engine to provide nominal and retarded intake valve closure for high and low compression operation, respectively.

FIG. 1 illustrates an end view of a first dual-lobed intake cam 10 in accordance with the present invention. Intake valve opening side 11 and closing side 13 are shown on opposite sides of the cam apex. Both cam lobes in this embodiment share a common nominal valve opening profile 15. The high compression cam lobe has a nominal valve closing profile 17 whereas the low compression cam lobe has a retarded valve closing profile 19.

Figure 2:
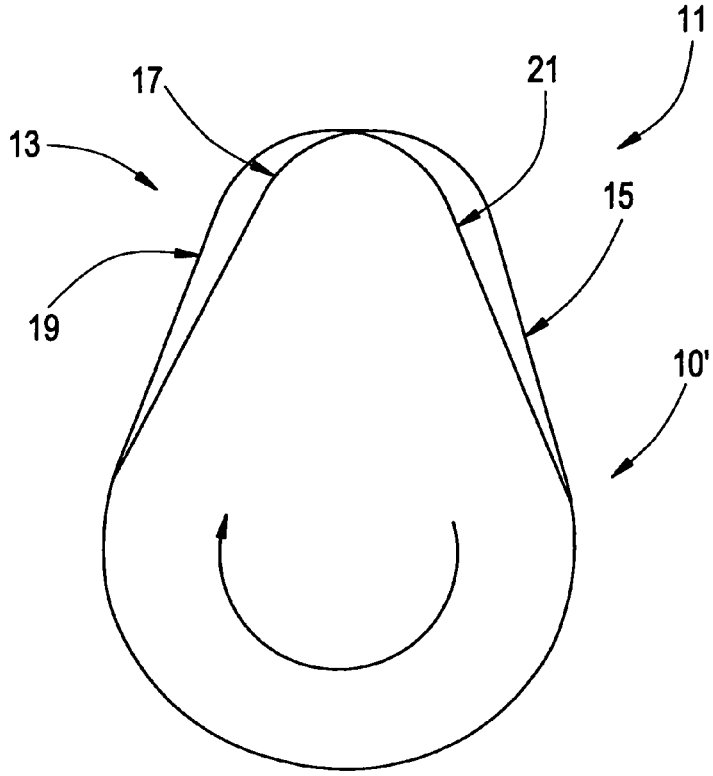
FIG. 2 is a profile view of a second dual-lobed intake cam for a diesel engine to provide retarded intake valve opening and nominal intake valve closure for high compression operation and nominal intake valve opening and retarded intake valve closure for low compression operation.

FIG. 2 illustrates an end view of a second dual-lobed intake cam 10' in accordance with the present invention. Intake valve opening side 11 and closing side 13 are shown on opposite sides of the cam apex. The high compression cam lobe has a retarded valve opening profile 21 and a nominal valve closing profile 17. The low compression cam lobe has a nominal valve opening profile 15 and a retarded valve closing profile 19.

Figure 3:
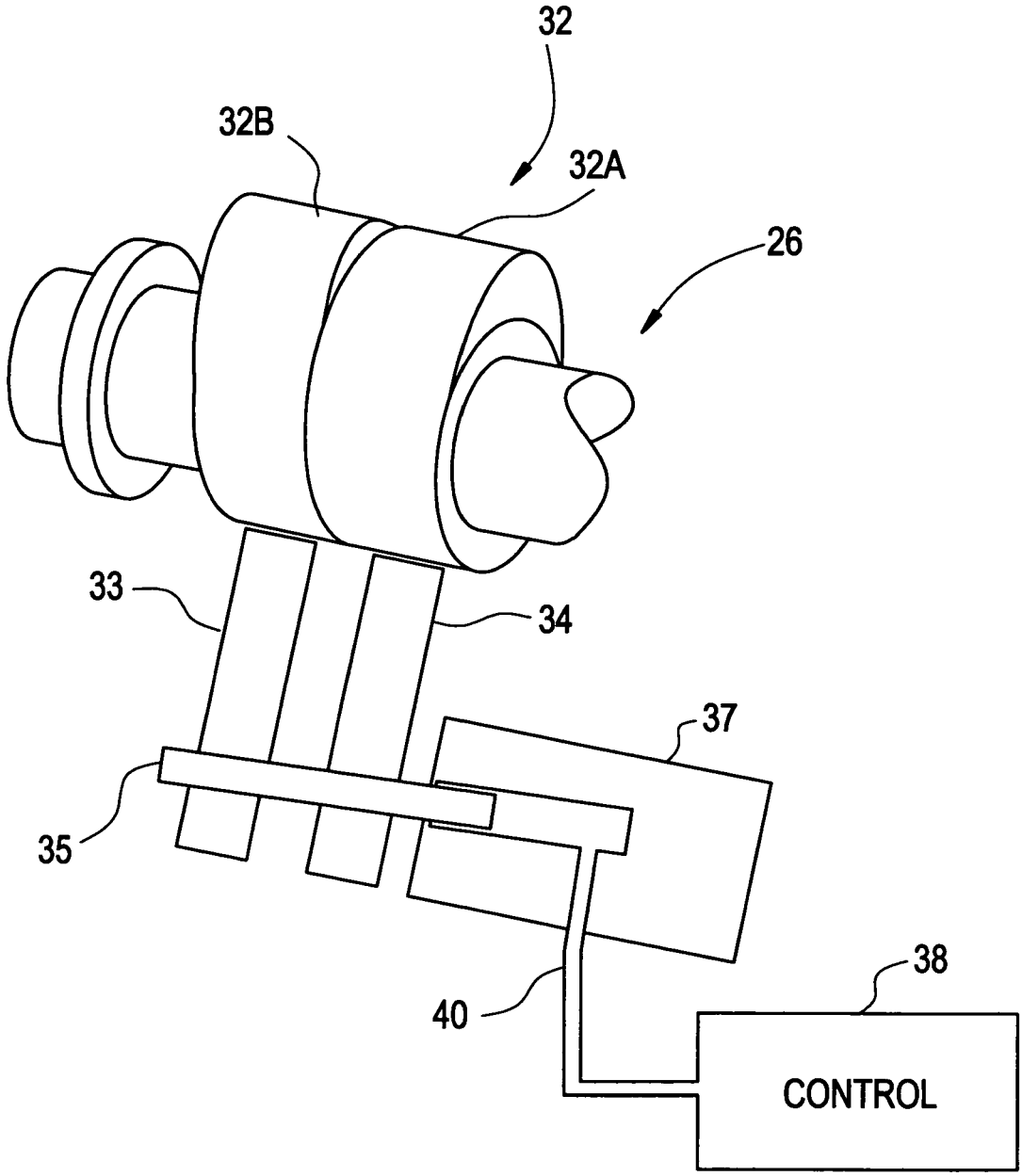
FIG. 3 is a schematic drawing of an exemplary dual-lobed intake cam and selection mechanism in accordance with the present invention.

Referring to FIG. 3, there is shown a schematic view of a portion of the intake camshaft 26 including cam 32 including a high compression cam lobe 32A and a low compression cam lobe 32B which engage rocker arm 34 and follower 33 respectively to selectively actuate the intake valves (not shown). Rocker arm 34 and follower 33 are selectively coupled and decoupled by pin 35 which is actuated by pin actuation mechanism 37 connected to control 38. Through internal passages 40, the control 38 provides pressurized oil to the pin actuation mechanism 37 as needed to displace pin 35 to couple the rocker arm 34 and follower 33 to move in unison. Control 38 also exhausts oil from pin actuation mechanism 37 to allow pin 35 to return to a position, such as by a return spring (not shown), whereby rocker 34 and follower 33 are decoupled to move independently. Rocker arm 34 is linked to an intake valve which is opened and closed in accordance with its motion. Follower 33 is not coupled to an intake valve and operates with lost motion unless coupled to rocker arm 34 through pin 35. The higher profile low compression cam lobe 32B causes actuation of the intake valve via follower 33 linked by pin 35 to rocker arm 34. Such cam lobe selection mechanisms are well known in the art of gasoline fueled engines. Other lost motion types of mechanisms are also known for engaging and disengaging rocker arms and followers to selectively operate in unison or independently.

Control 38 comprises a conventional microprocessor-based engine or powertrain controller including CPU, ROM, RAM, I/O circuitry including A/D and D/A conversion and serial data bus communications. Control 38 monitors or derives a variety of parameters used in engine and powertrain controls including non exhaustive exemplary parameters such as engine coolant temperature, intake air temperature and mass flow, manifold pressure, exhaust gas constituents, engine speed, crankshaft angles and engine output torque. Control 38 further includes a variety of controlled actuators and control signal therefore such as solenoids and motors including for providing and exhausting pressurized oil to and from the actuation mechanism 37 to effect positional control of pin 35.

Figure 4:
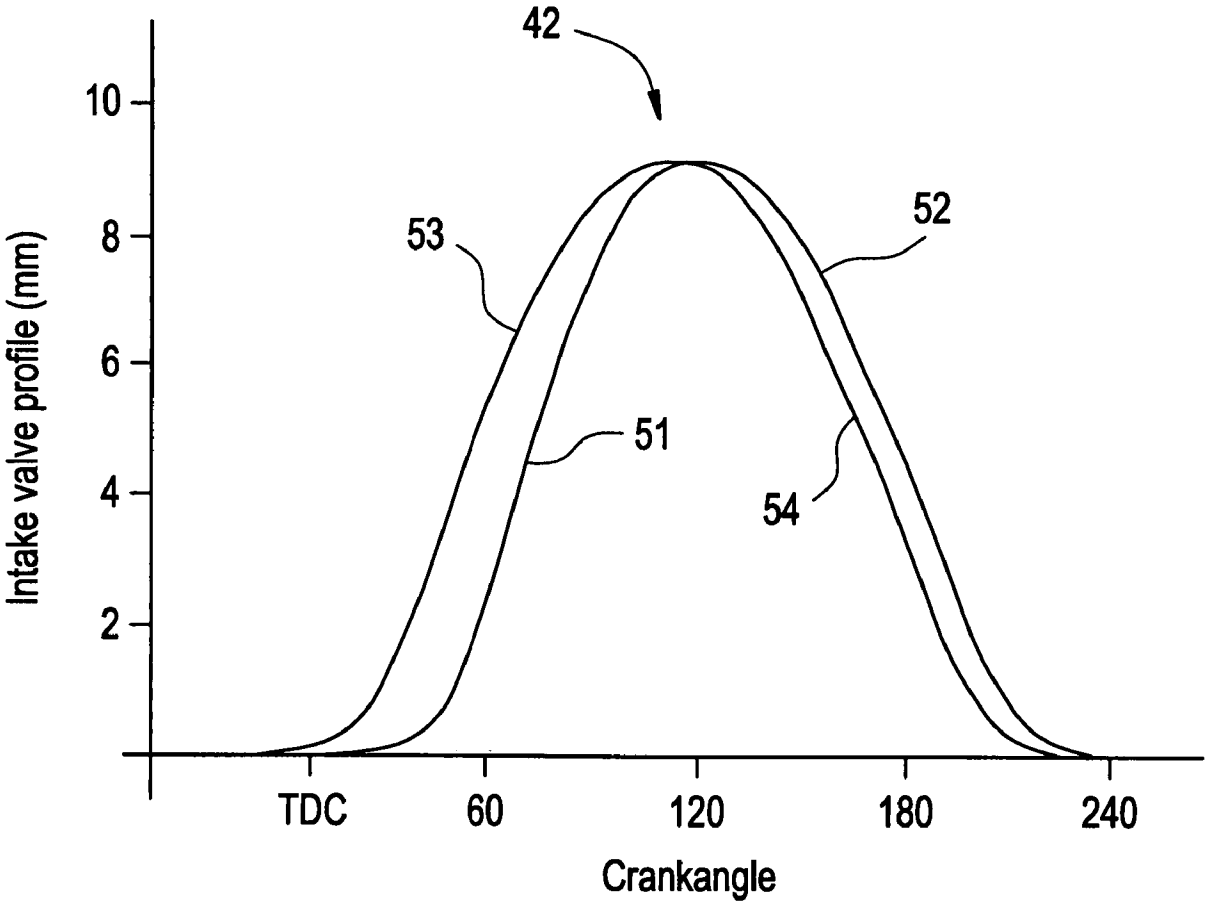
FIG. 4 is a valve lift diagram showing the variation in intake cam timing by the dual-lobed cams in accordance with the present invention.

Referring now to FIG. 4 of the drawings, there is illustrated a valve timing diagram. The lift motions of the valves are illustrated by an intake curve 42. As illustrated for high compression operation in accordance with the first dual-lobed cam 10 in FIG. 1, the intake valve opening begins at about 16 degrees before top dead center (BTDC) and proceeds along nominal lift curve 53 to a peak at about 100 degrees after top dead center (ATDC). Thereafter, the intake valve proceeds down nominal closing curve 54 to valve closing at slightly after 220 degrees ATDC. Operation with this high compression valve timing provides a relatively high compression ratio in the engine which may approximate 15.5/1 to 20/1 depending on the design of the particular engine.

For low compression operation in accordance with the first dual-lobed cam 10 in FIG. 1, the intake valve opening begins at about 16 degrees BTDC and proceeds along nominal lift curve 53 to a peak at about 100 degrees ATDC. Thereafter, the intake valve proceeds down retarded closing curve 52 to valve closing at about 240 degrees ATDC. Operation with this low compression valve timing provides a relatively low compression ratio in the engine which may approximate 11/1 to 15/1 depending on the design of the particular engine. With this retarded timing of the intake valve closing and this nominal intake valve opening, the intake valve closing is delayed relative to the nominal timing by about 20 degrees. Thus, the effective compression stroke is shortened by about 20 degrees from that of the high compression intake valve cam lobe of FIG. 1. The result is that the effective compression ratio of the engine is reduced.

With continued reference to FIG. 4 of the drawings and for high compression operation in accordance with the second dual-lobed cam 10' in FIG. 2, the intake valve opening begins slightly before 40 degrees ATDC and proceeds along retarded lift curve 51 to a peak at about 110–130 degrees ATDC. Thereafter, the intake valve proceeds down nominal closing curve 54 to valve closing at slightly after 220 degrees ATDC. Operation with this high compression valve timing provides a relatively high compression ratio in the engine which may approximate 14/1 to 18/1 depending on the design of the particular engine. With this retarded timing of the intake valve opening and this nominal intake valve closing, the intake valve opening is delayed relative to the nominal timing until about 36 degrees after top dead center (ATDC) of the respective pistons. Thus, the temperature of the charge is increased (relative to the low compression ratio case) due to the intake throttling and the higher compression ratio. The result is that more robust combustion will be achieved during cold running operation.

For low compression operation in accordance with the second dual-lobed cam 10' in FIG. 2, the intake valve opening begins at about 16 degrees BTDC and proceeds along nominal lift curve 53 to a peak at about 100 degrees ATDC. Thereafter, the intake valve proceeds down retarded closing curve 52 to valve closing at about 240 degrees ATDC. Operation with this low compression valve timing provides a relatively low compression ratio in the engine which may approximate 11/1 to 15/1 depending on the design of the particular engine. With this retarded timing of the intake valve closing and this nominal intake valve opening, the intake valve closing is delayed relative to the nominal timing by about 20 degrees. Thus, the effective compression stroke is shortened by about 20 degrees from that of the high compression intake valve cam lobe of FIG. 1. The result is that the effective compression ratio of the engine is reduced.

In operation, the high compression mode of operation is utilized for cold engine starting and warm-up. This is necessary because the intake air charge must be compressed to a gas temperature high enough to provide reliable and consistent compression ignition of fuel injected into the combustion chambers near their piston top dead center positions. After the engine is warmed up and the cylinder and piston walls are heated, reduction of the compression ratio to a lower range, such as 12/1 to 16/1 depending on the engine configuration, can be utilized to provide effective compression ignition to operate with reduced combustion temperatures in order to control or limit NOx emissions. Thus, during warmed-up conditions, the low compression mode of operation is utilized.

While this will provide reduced combustion temperatures resulting in a reduction of NOx emissions, the effect is limited by fuel heating of the smaller gas charge. With a turbocharged or supercharged engine, the boost level may be increased to provide a trapped mass of the intake gas charge, including air and exhaust gases if needed, that is equivalent to the mass provided without the reduced compression ratio. Burning and expansion of the larger charge with the reduced compression ratio then results in a greater temperature reduction and a resulting greater reduction in NOx emissions.

When the engine is again operated at light loads or during starting and warm-up, the pin 35 is returned to its retracted position, the high compression cam lobe is again effective, and the compression ratio is again increased so that dependable compression ignition of the intake air fuel charge is obtained.

In order to use a dual-lobed intake cam in the manner outlined for reducing the effective compression ratio and resulting compression temperatures of a diesel engine, the cam lobes must not advance the intake valve opening. The variations in valve timing for which dual-lobed cams are utilized in spark ignition engines are not generally usable in diesel engines because the intake valve timing cannot be advanced without the pistons contacting the valves due to the low piston to head clearance.

Thus, the application of dual-lobed cams to a diesel engine is not known to have previously been considered practical. However, the use in the present invention, where only retarding of the intake valves from their nominal timing is utilized, provides a simple and low cost method of controlling combustion temperatures and controlling NOx emissions in warmed-up operation of a diesel engine.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Diesel engine having cylinders and pistons defining expansible combustion chambers into which combustion supporting gas is compressed during compression strokes of the pistons for compression ignition and burning of injected fuel to drive a crankshaft, intake and exhaust valves actuated by crankshaft driven intake and exhaust camshafts for controlling the timed admission of air to and the discharge of exhaust from the combustion chambers, and for each cylinder the improvement comprising:

an intake camshaft having first and second cam lobes of different profiles on the intake camshaft wherein the first and second cam lobes have respective intake valve opening profiles that are not advanced relative to a nominal profile, and further wherein the first cam lobe has a first intake valve closing profile and the second cam lobe has a second intake valve closing profile that is retarded relative to the first intake valve closing profile; and, a selection mechanism for selectively coupling one of the two cam lobes to respective intake valves, whereby the first intake valve closing profile effects a relatively high effective compression ratio and high combustion temperatures and the second intake valve closing profile effects a relatively low effective compression ratio and low combustion temperatures.

2. The diesel engine as claimed in claim 1 wherein the first and second cam lobes have substantially identical intake valve opening profiles.

3. The diesel engine as claimed in claim 1 wherein the first cam lobe has a first intake valve opening profile and the second cam lobe has a second intake valve opening profile, said first intake valve opening profile being retarded relative to the second intake valve opening profile, whereby the first intake valve opening profile effects throttling of admitted air and high combustion temperatures relative to the second intake valve opening profile.

4. The diesel engine as claimed in claim 1 wherein the second intake valve closing profile is retarded relative to the first intake valve closing profile by about 5 to about 35 crankshaft degrees.

5. The diesel engine as claimed in claim 3 wherein the first intake valve opening profile is retarded relative to the second intake valve opening profile by about 20 to about 65 crankshaft degrees.

6. The diesel engine as claimed in claim 3 wherein the second intake valve closing profile is retarded relative to the first intake valve closing profile by about 5 to about 35 crankshaft degrees and the first intake valve opening profile is retarded relative to the second intake valve opening profile by about 20 to about 65 crankshaft degrees.

7. The diesel engine as claimed in claim 1 wherein the second intake valve closing profile is retarded relative to the first intake valve closing profile by about 20 crankshaft degrees.

8. The diesel engine as claimed in claim 3 wherein the first intake valve opening profile is retarded relative to the second intake valve opening profile by about 56 crankshaft degrees.

9. The diesel engine as claimed in claim 3 wherein the second intake valve closing profile is retarded relative to the first intake valve closing profile by about 20 crankshaft degrees and the first intake valve opening profile is retarded relative to the second intake valve opening profile by about 56 crankshaft degrees.

10. Method for operating a diesel engine comprising:

providing an intake camshaft having respective first and second cam lobes characterized by intake valve opening profiles that are not advanced relative to a nominal profile wherein the first cam lobes are characterized by a first intake valve closing profile and the second cam are lobes characterized by a second intake valve closing profile that is retarded relative to the first intake valve closing profile;

selectively actuating the intake valves with the first cam lobes to the exclusion of the second cam lobes for cold engine starting and warm-up; and, selectively actuating the intake valves with the second cam lobes to the exclusion of the first cam lobes for warmed-up engine conditions.

11. The method for operating a diesel engine as claimed in claim 10 comprising further providing said intake camshaft having the first cam lobes characterized by a first intake valve opening profile and the second cam lobes characterized by a second intake valve opening profile, said first intake valve opening profile being retarded relative to the second intake valve opening profile.

12. The method for operating a diesel engine as claimed in claim 10 wherein the second intake valve closing profile is retarded relative to the first intake valve closing profile by about 5 to about 35 crankshaft degrees.

13. The method for operating a diesel engine as claimed in claim 11 wherein the first intake valve opening profile is retarded relative to the second intake valve opening profile by about 20 to about 65 crankshaft degrees.

14. The method for operating a diesel engine as claimed in claim 11 wherein the second intake valve closing profile is retarded relative to the first intake valve closing profile by about 5 to about 35 crankshaft degrees and the first intake valve opening profit is retarded relative to the second intake valve opening profile by about 20 to bout 65 crankshaft degrees.

15. The method for operating a diesel engine as claimed in claim 10 wherein the second intake valve closing profile is retarded relative to the first intake valve closing profile by about 20 crankshaft degrees.

16. The method for operating a diesel engine as claimed in claim 11 wherein the first intake valve opening profile is retarded relative to the second intake valve opening profile by about 56 crankshaft degrees.

17. The method for operating a diesel engine as claimed in claim 11 wherein the second intake valve closing profile is retarded relative to the first intake valve closing profile by about 20 crankshaft degrees and the first intake valve opening profile is retarded relative to the second intake valve opening profile by about 56 crankshaft degrees.

18. The method for operating a diesel engine as claimed in claim 10 further comprising boosting pressure of cylinder charge gases when the intake valves are actuated with the second cam lobes.

19. The method for operating a diesel engine as claimed in claim 11 further comprising boosting pressure of cylinder charge gases when the intake valves are actuated with the second cam lobes.

20. Diesel engine having cylinders and pistons defining expansible combustion chambers into which combustion supporting gas is compressed during compression strokes of the pistons for compression ignition and burning of injected fuel to drive a crankshaft, intake and exhaust valves actuated by crankshaft driven intake and exhaust camshafts for controlling the timed admission of air to and the discharge of exhaust from the combustion chambers, and for each cylinder the improvement comprising:

an intake camshaft having first cam lobes having a first intake valve closing profile and a first intake valve opening profile and second cam lobes having a second intake valve closing profile and a second intake valve opening profile, wherein said second intake valve closing profile is retarded relative to the first intake valve closing profile, said first and second intake valve opening profiles are not advanced relative to a nominal profile, and the first intake valve opening profile is retarded relative to the second intake valve opening profile; and, a selection mechanism for selectively coupling one of the two cam lobes to respective intake valves, whereby the first cam lobes effect a relatively high compression ratio and high combustion temperatures and the second cam lobes effect a relatively low compression ratio and low combustion temperatures.

* * * * *